US007567225B2

(12) United States Patent
Chae et al.

(10) Patent No.: US 7,567,225 B2
(45) **Date of Patent: *Jul. 28, 2009**

(54) PLASMA DISPLAY PANEL DRIVING DEVICE HAVING A ZENER DIODE

(75) Inventors: Seung-Hun Chae, Suwon-si (KR); Woo-Joon Chung, Suwon-si (KR); Jin-Sung Kim, Suwon-si (KR); Kyoung-Ho Kang, Suwon-si (KR); Tae-Seong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 636 days.

This patent is subject to a terminal disclaimer.

(21) Appl. No.: 10/965,046

(22) Filed: Oct. 15, 2004

(65) Prior Publication Data

US 2005/0083262 A1 Apr. 21, 2005

(30) Foreign Application Priority Data

Oct. 16, 2003 (KR) ..... 10-2003-0072323

(51) Int. Cl.
*G09G 3/28* (2006.01)

(52) U.S. Cl. ..... 345/60; 345/69

(58) Field of Classification Search ..... 345/60–72, 345/98, 41; 315/169.4; 323/231; 324/523; 318/439

See application file for complete search history.

(56) References Cited

U.S. PATENT DOCUMENTS 4,384,287 A * 5/1983 Sakuma ..... 345/60
4,652,796 A * 3/1987 Delgrange et al. ..... 315/169.4
5,081,400 A * 1/1992 Weber et al. ..... 315/169.4
6,150,767 A * 11/2000 Huang ..... 315/169.4
6,275,013 B1 * 8/2001 Higuchi ..... 323/231
6,294,875 B1 9/2001 Kurata et al. ..... 315/169.1
6,483,250 B1 * 11/2002 Hashimoto et al. ..... 315/169.4
6,639,410 B2 * 10/2003 Kamitani ..... 324/523
6,724,357 B2 * 4/2004 Kim et al. ..... 345/60
6,822,409 B2 * 11/2004 Lange et al. ..... 318/439
2002/0186184 A1 * 12/2002 Lim ..... 345/60
2003/0098822 A1 * 5/2003 Park et al. ..... 345/60
2003/0107532 A1 6/2003 Choi
2003/0122740 A1 7/2003 Lee
2003/0231156 A1 * 12/2003 Takeuchi et al. ..... 345/98
2004/0085262 A1 * 5/2004 Lee ..... 345/41
2005/0093781 A1 * 5/2005 Chae et al. ..... 345/66

FOREIGN PATENT DOCUMENTS

CN 1377019 10/2002
JP 06222734 8/1994
WO 02101707 12/2002

* cited by examiner

*Primary Examiner*—Chanh Nguyen
*Assistant Examiner*—Adam J Snyder
(74) *Attorney, Agent, or Firm*—H.C. Park & Associates, PLC

(57) ABSTRACT

A plasma display panel driver for applying a Zener diode to a falling ramp driving circuit, and reducing a falling ramp driving initial voltage to a voltage that causes a discharge. The driver comprises a transistor having a first electrode coupled between a first terminal of a panel capacitor and a power source; a capacitor having a first terminal coupled to a control electrode of the transistor; and a first resistor, a diode, and a Zener diode coupled in parallel between a second terminal of the capacitor and the first electrode of the transistor.

5 Claims, 5 Drawing Sheets

PLASMA DISPLAY PANEL DRIVING DEVICE HAVING A ZENER DIODE

CROSS REFERENCE TO RELATED APPLICATION

This application claims priority to and the benefit of Korean Patent Application No. 10-2003-0072323, filed on Oct. 16, 2003, which is hereby incorporated by reference for all purposes as if fully set forth herein.

BACKGROUND OF THE INVENTION

1. Field of the Invention

The present invention relates to a plasma display panel (PDP) driving device and method.

2. Discussion of the Related Art

Generally, among flat panel displays, PDPs are regarded as having better luminance and light emission efficiency, as well as wider view angles. Therefore, PDPs are being considered as the primary substitute for the conventional cathode ray tubes for large displays of greater than 40 inches.

The PDP uses plasma generated via a gas discharge process to display characters or images, and tens of thousands to millions of pixels may be provided in a matrix, depending on its size. PDPs are categorized into direct current (DC) PDPs and alternating current (AC) PDPs according to supplied driving voltage waveforms and discharge cell structures.

Since the DC PDPs have electrodes exposed in the discharge space, they allow a current to flow when a voltage is supplied, which requires resistors for current restriction. On the other hand, since the AC PDPs have electrodes covered by a dielectric layer, naturally formed capacitances restrict the current, and the dielectric layer also protects the electrodes from ion shocks due to discharging. Accordingly, they have a longer lifespan than the DC PDP.

FIG. 1 shows a perspective view of a conventional AC PDP.

As shown, parallel pairs of a scan electrode 4 and a sustain electrode 5, covered by a dielectric layer 2 and a protection film 3, are provided on a lower surface of a first glass substrate 1. A plurality of address electrodes 8, covered with an insulation layer 7, is formed on an upper surface of a second glass substrate 6. Barrier ribs 9 are formed in parallel with, and between, the address electrodes 8, on the insulation layer 7, and phosphor layers 10 are formed on the surface of the insulation layer 7 and the sides of the barrier ribs 9. The first and second glass substrates 1 and 6 are sealed together to form a discharge space 11 between them, and the scan electrode 4 and the sustain electrode 5 pair are orthogonal to the address electrode 8. Discharge cells 12 are formed in the discharge space at intersections of the address electrode 8 and the scan electrode 4 and the sustain electrode 5 pair.

FIG. 2 shows a typical PDP electrode arrangement.

As shown, the PDP electrodes have an m×n matrix configuration. Address electrodes $A_1$ to $A_m$ are arranged in the column direction, and scan electrodes $Y_1$, to $Y_n$ (Y electrodes) and sustain electrodes $X_1$ to $X_n$ (X electrodes) are alternately arranged in the row direction.

FIG. 3 shows a conventional PDP driving waveform.

Each subfield includes a reset period, an address period, and a sustain period.

The reset period erases wall charge states of a previous sustain and sets up wall charges in order to stably perform a next addressing operation. In the address period, the cells that are to be turned on are selected, and wall charges are accumulated to those selected cells. In the sustain period, discharges for actually displaying images on the PDP are performed.

The following describes operations of the conventional reset period. As shown in FIG. 3, the conventional reset period may include an erase period, a Y ramp rising period, and a Y ramp falling period.

(1) Erase Period

Positive charges are accumulated on the X electrodes, and negative charges are accumulated on the Y electrodes after finishing the last sustain discharge. In this state, an erase ramp voltage that gently rises from 0 V to the voltage of $+V_e$ is applied to the X electrode, thereby eliminating the wall charges formed on the X and Y electrodes.

(2) Y Ramp Rising Period

During this period, the address electrode and the X electrode maintain 0V, and a ramp voltage gradually rising from the voltage of $V_s$ to the voltage of $V_{set}$ is applied to the Y electrode. While the ramp voltage rises, a first weak reset discharge is generated to all the discharge cells from the Y electrode to the address electrode and the X electrode. As a result, negative wall charges accumulate to the Y electrode, and positive wall charges accumulate to the address electrode and the X electrode.

(3) Y Ramp Falling Period

In the latter part of the reset period, a ramp voltage that gradually falls from the voltage of $V_s$ to the 0V is applied to the Y electrode while the X electrode maintains a voltage of $V_e$. While the ramp voltage falls, a second weak reset discharge is generated at all the discharge cells.

According to the conventional reset method shown in FIG. 3, a reset discharge is generated in the Y ramp rising period and the Y ramp falling period to control the amount of wall charges within the cell, and hence, an accurate addressing operation may be carried out subsequently.

In the Y falling ramp period, however, the discharge is not generated until the voltage at the Y electrode reaches a predetermined voltage. As shown in FIG. 3, during the Y ramp falling period, the voltage at the Y electrode falls to the voltage of Vs and maintains that voltage for a short period before gradually falling.

However, the voltage for actually generating the second discharge may be lower than the voltage of Vs. Hence, an unneeded period in which no discharge is generated may be provided after applying the Y ramp falling pulse, which increases the length of the reset period and the total driving time.

SUMMARY OF THE INVENTION

The present invention provides a PDP driver that may reduce a length of time for the reset period.

Additional features of the invention will be set forth in the description which follows, and in part will be apparent from the description, or may be learned by practice of the invention.

The present invention discloses a PDP driver for applying a reset driving waveform in a ramp pulse format to a panel capacitor, comprising a transistor having a first electrode coupled between a first terminal of the panel capacitor and a power source and a capacitor having a first terminal coupled to a control electrode of the transistor. A first resistor, a diode, and a Zener diode are coupled in parallel between a second terminal of the capacitor and the first electrode of the transistor.

The present invention also discloses a PDP driver for applying a reset driving waveform in a ramp pulse format to a panel capacitor comprising a transistor having a first electrode coupled between a first terminal of the panel capacitor and a power source, and a capacitor having a first terminal coupled to a control electrode of the transistor. A second terminal of the capacitor is coupled in series to a zener diode, and a first resistor and a diode are coupled in parallel between the first electrode and the Zener diode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
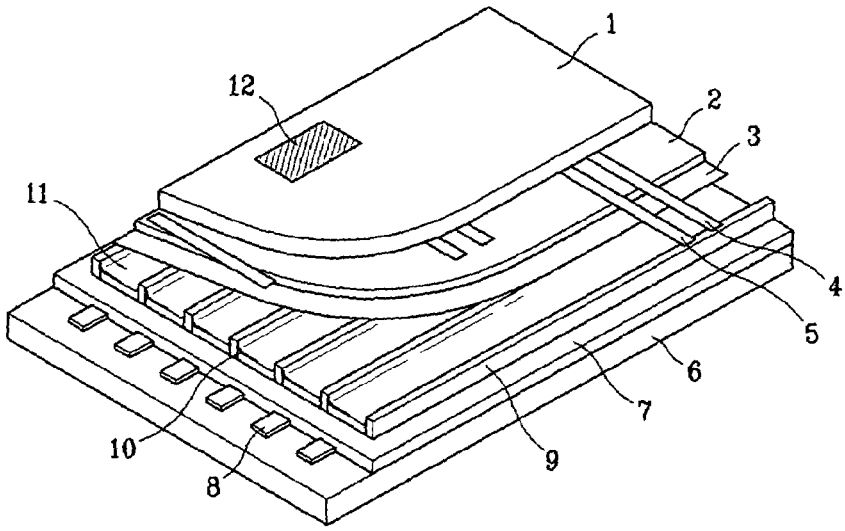
FIG. 1 (Prior Art)
FIG. 1 shows a partial perspective view of a conventional AC PDP.
Figure 2:
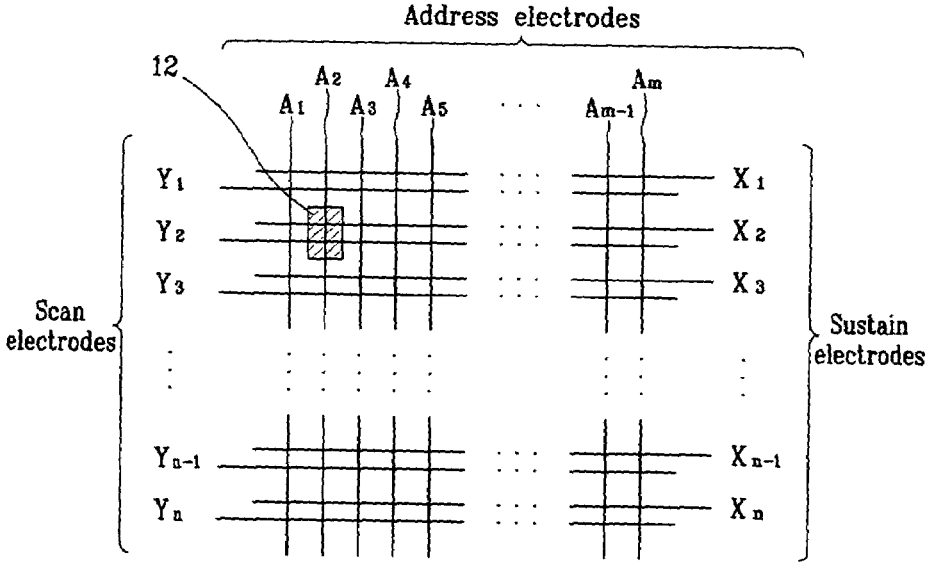
FIG. 2 (Prior Art)
FIG. 2 shows a typical PDP electrode arrangement.
Figure 3:
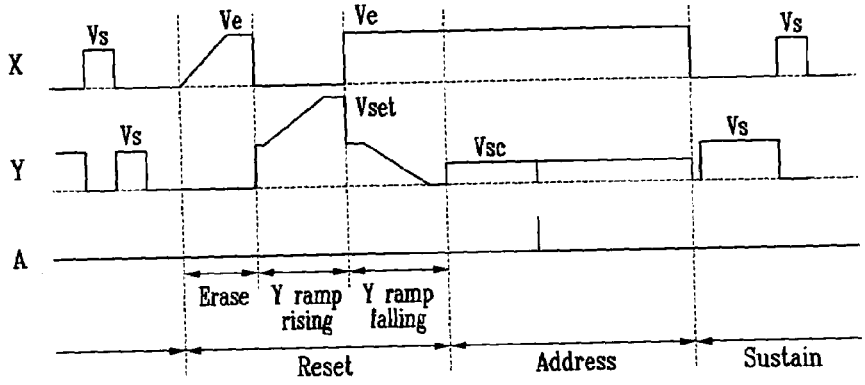
FIG.3(Prior Art)
FIG. 3 shows a conventional PDP driving waveform.

The following detailed description shows and describes exemplary embodiments of the invention, simply by way of illustration of the best mode contemplated by the inventors of carrying out the invention. As will be realized, the invention is capable of modification in various obvious respects, all without departing from the invention. Accordingly, the drawings and description are illustrative in nature, and not restrictive. To clarify the present invention, parts that are not described in the specification are omitted, and parts for which similar descriptions are provided have the same reference numerals.

A PDP driving method according to the first exemplary embodiment of the present invention will be described in detail with reference to FIG. 4, FIG. 5 and FIG. 6.

Figure 4:
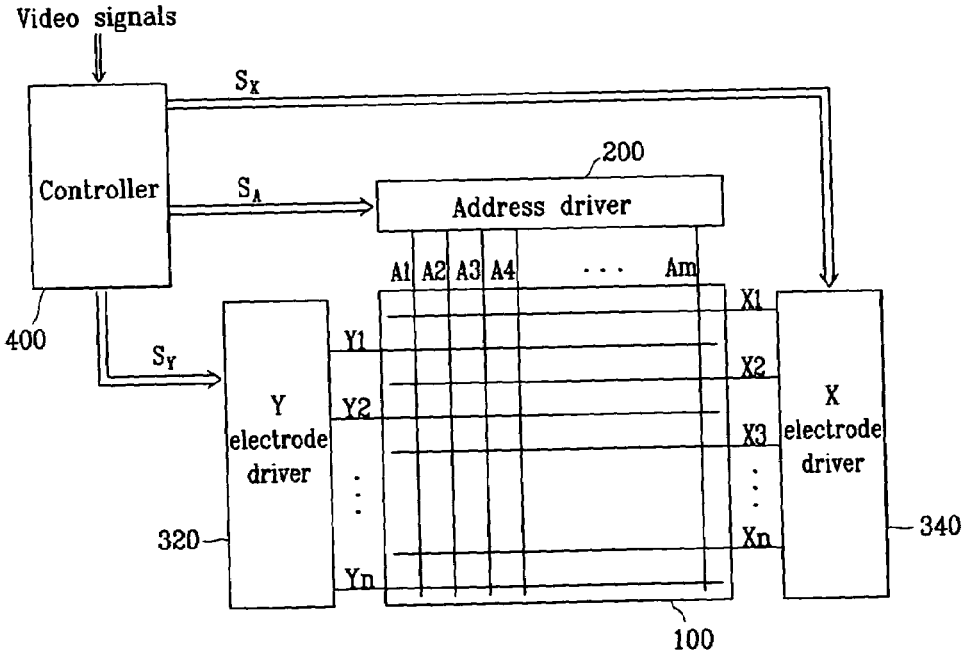
FIG. 4 shows a PDP according to a first exemplary embodiment of the present invention.

FIG. 4 shows a PDP according to the first exemplary embodiment of the present invention.

As shown, the PDP comprises a plasma panel 100, an address driver 200, a Y electrode driver 320, an X electrode driver 340, and a controller 400.

The plasma panel 100 comprises a plurality of address electrodes $A_l$ to $A_m$ arranged in the column direction, and a plurality of Y electrodes $Y_1$ to $Y_n$ and X electrodes $X_1$ to $X_n$ alternately arranged in the row direction.

The controller 400 receives external video signals and generates an address driving control signal $S_A$, a Y electrode driving signal $S_Y$, and an X electrode driving signal $S_X$, and transmits them to the address driver 200, the Y electrode driver 320, and the X electrode driver 340.

The address driver 200 receives the address driving control signal $S_A$ and applies a display data signal to the respective address electrodes for selecting a discharge cell to be displayed.

The Y electrode driver 320 and the X electrode driver 340 receive a Y electrode driving signal $S_Y$ and an X electrode driving signal $S_X$ and apply them to the Y and X electrodes.

Figure 5:
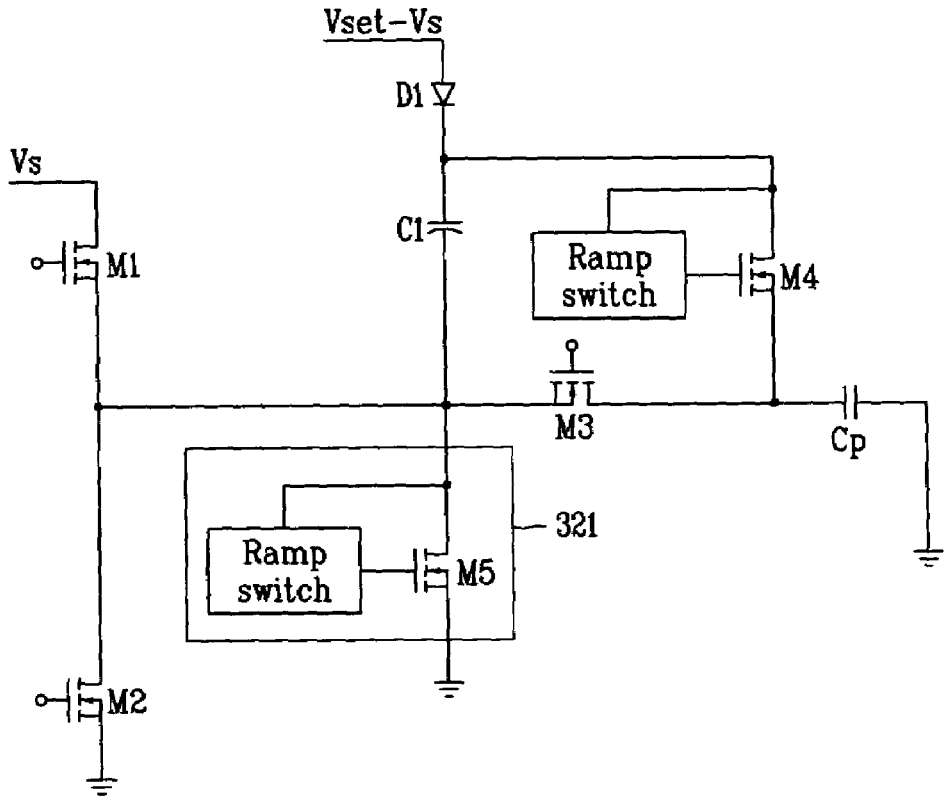
FIG. 5 shows a Y electrode driving circuit of the PDP according to the first exemplary embodiment of the present invention.
Figure 6:
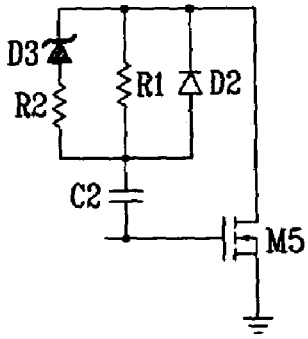
FIG. 6 shows a a falling ramp driving circuit according to the first exemplary embodiment of the present invention.
Figure 7:
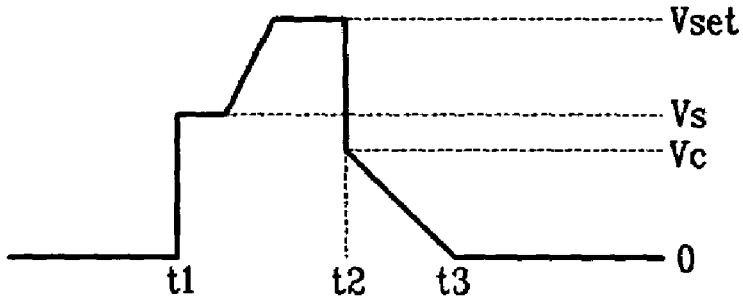
FIG. 7 shows a PDP driving waveform according to the first exemplary embodiment of the present invention.

FIG. 5 shows a detailed diagram of the Y electrode driver 320 according to the first exemplary embodiment of the present invention, FIG. 6 shows a falling ramp driving circuit according to the first exemplary embodiment of the present invention, and FIG. 7 shows a reset driving waveform applied to the Y electrode by the falling ramp driving circuit of the first exemplary embodiment of the present invention.

As shown in FIG. 5, the Y electrode driver 320 comprises transistors $M_1$ and $M_2$ coupled in series between the sustain discharge voltage of $V_s$ and a ground voltage, and a transistor $M_3$ is coupled between a node of the transistors $M_1$ and $M_2$ and a Y electrode of the panel capacitor $C_p$. In this case, the panel capacitor $C_p$ represents a capacitance component between the X and Y electrodes. Additionally, the X electrode of the panel capacitor $C_p$ is shown coupled to the ground terminal for ease of description, but it is actually coupled to the X electrode driver 340.

A first terminal of a capacitor $C_1$ is coupled to the node of the transistors $M_1$ and $M_2$, and a diode $D_1$ is coupled between a voltage of $(V_{set}-V_s)$ and a second terminal of the capacitor $C_1$. A transistor $M_4$, for applying a rising ramp voltage to the Y electrode, is formed between the first terminal of the panel capacitor $C_p$, which corresponds to the Y electrode, and the second terminal of the capacitor $C_1$. The transistor $M_4$ is coupled to a ramp switch that includes a capacitor formed between a drain and a gate to supply a constant current between a source and the drain.

A falling ramp driving circuit 321, which includes a transistor $M_5$ for applying a falling ramp voltage to the Y electrode, is coupled between the first terminal of the panel capacitor $C_p$, which corresponds to the Y electrode, and the ground voltage. The transistor $M_5$ is coupled to a ramp switch that includes a capacitor formed between a drain and a gate to supply a constant current between a source and the drain.

As shown in FIG. 6, the falling ramp driving circuit 321 comprises a resistor $R_1$, a diode $D_2$, and a Zener diode $D_3$ coupled in parallel between a first terminal of the capacitor $C_2$ and a drain of the transistor $M_5$. Additionally, a resistor $R_2$ is coupled in series to the Zener diode $D_3$. The resistor $R_1$ forms a charging path of the capacitor $C_2$, the diode $D_2$ forms a discharging path thereof, and the Zener diode $D_3$ operates as a constant voltage source in the breakdown region. The resistor $R_2$ prevents the voltage charged in the capacitor $C_2$ from discharging in the region where the Zener diode $D_3$ functions as a general diode.

A driving method according to the first exemplary embodiment will be described in further detail with reference to FIG. 5, FIG. 6 and FIG. 7.

At time t1, the transistors $M_2$, $M_3$ and $M_5$ turn off, and the transistors $M_1$ and $M_4$ turn on. The voltage of $V_s$ is supplied to the first terminal of the capacitor $C_1$, and the voltage at the second terminal of the capacitor $C_1$ reaches the voltage of $V_{set}$ since the capacitor $C_1$ is charged with the voltage of $(V_{set}-V_s)$ before time $t_1$. The voltage of $V_{set}$ is also supplied to the Y electrode of the panel capacitor $C_p$ through the transistor $M_4$. Between times $t_1$ and $t_2$, a ramp voltage rising from the second voltage of $V_s$ to the third voltage of $V_{set}$ is applied to the Y electrode of the panel capacitor $C_p$ since a constant current flows between the source and the drain of the transistor $M_4$.

During times $t_1$ and $t_2$, the capacitor $C_2$ is charged with a voltage supplied from the voltage source of $V_s$ through the resistor $R_1$, and the Zener diode $D_3$ stays off until the voltage at the resistor $R_1$ reaches the breakdown voltage of the Zener diode $D_3$. Once the voltage at the resistor $R_1$ reaches the breakdown voltage, the Zener diode $D_3$ turns on, a subsequent voltage at the resistor $R_1$ is fixed at the breakdown voltage, and the capacitor $C_2$ is charged with a third voltage of $V_c$, which equals a difference between the voltage at the Y electrode of the capacitor $C_p$ and the breakdown voltage of the Zener diode $D_3$.

The voltage of $V_c$ may be a voltage at which a weak reset discharge is generated, and it may be controlled by controlling the breakdown voltage of the Zener diode $D_3$.

At time $t_2$, the transistors $M_2$, $M_3$ and $M_5$ turn on, the transistors $M_1$ and $M_4$ turn off, and the voltage of $V_c$ is applied to the Y electrode. At time $t_2$, with the transistor $M_1$ off and the transistors $M_3$ and $M_5$ on, a reverse current flows to the Zener diode $D_3$, and it operates like a general diode. Therefore, the voltage at the Y electrode of the panel capacitor $C_p$ is instantly reduced to the charging voltage of $V_c$ at the capacitor $C_2$. Since a constant current flows between the drain and the source of the transistor $M_5$ due to the influence of the capacitor $C_2$, the voltage at the Y electrode of the capacitor $C_p$ falls to the ground voltage from the voltage of $V_c$ in a ramp manner. Also, since the resistor $R_2$ is coupled in series to the Zener diode $D_3$, the voltage of $V_c$ charged in the capacitor $C_2$ is discharged through the diode $D_2$ and the drain-source path of the transistor $M_5$.

According to the reset driving method of the first embodiment as described above, the Zener diode $D_3$ controls the voltage charged in the capacitor $C_2$ in the Y ramp rising period, thus reducing the initial voltage of the Y ramp falling period to a voltage at which a weak reset discharge is generated, thereby reducing the length of the reset period.

Figure 8:
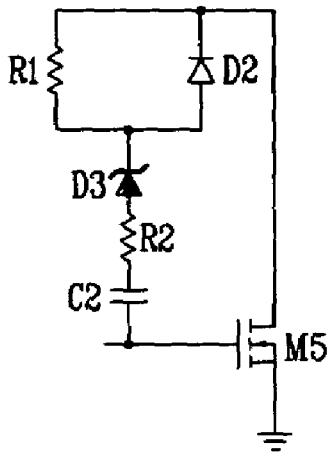
FIG. 8 shows a a falling ramp driving circuit according to a second exemplary embodiment of the present invention.

The Zener diode $D_3$ and the resistor $R_2$, which are coupled in series, are coupled in parallel to the diode $D_2$ and the resistor $R_1$ in the first exemplary embodiment. As shown in FIG. 8, they may also be coupled in series between the capacitor $C_2$, and the diode $D_2$ and the resistor $R_1$, which are coupled in parallel.

FIG. 8 shows a circuit diagram of a Y falling ramp driving circuit according to a second exemplary embodiment of the present invention.

Regarding operation of the Y electrode driver 320, the capacitor $C_2$ is charged through the path in the order of the resistor $R_1$, the Zener diode $D_3$, and the resistor $R_2$ in the rising ramp period.

Similar to the first embodiment, the Zener diode $D_3$ stays off until reaching its breakdown voltage. Upon reaching its breakdown voltage, the Zener diode $D_3$ turns on and remains fixed at the breakdown voltage, and the capacitor $C_2$ is charged with the voltage of $V_c$, which is a difference between the voltage at the Y electrode of the capacitor $C_p$ and the breakdown voltage of the Zener diode $D_3$.

Also, with the transistor $M_1$ off and the transistors $M_3$ and $M_5$ on in the falling ramp period, a reverse current flows to the Zener diode $D_3$, and the Zener diode $D_3$ operates like a general diode. Therefore, the voltage at the Y electrode of the panel capacitor $C_p$ is instantly reduced to the charged voltage of $V_c$ of the capacitor $C_2$. Since a constant current flows between the source and the drain of the transistor $M_5$ because of the influence of the capacitor $C_2$, the voltage at the Y electrode of the capacitor $C_p$ is reduced to the ground voltage from the voltage of $V_c$ in a ramp manner. The voltage $V_c$ charged in the capacitor $C_2$ is discharged through the resistor $R_2$, the Zener diode $D_3$, the diode $D_2$ and the drain-source path of the transistor $M_5$.

When dividing a field into eight subfields and driving them, a falling ramp pulse may be applied after a rising ramp pulse in the reset period of the first subfield. On the other hand, a falling ramp pulse may be applied without the rising ramp pulse in the reset period of the second to eighth subfields, as disclosed in U.S. Pat. No. 6,294,875. While first and second exemplary embodiments of the present invention describe the falling ramp pulse applicable to the first subfield, the present invention is also applicable to the falling ramp pulse of the second to eighth subfields.

Figure 9:
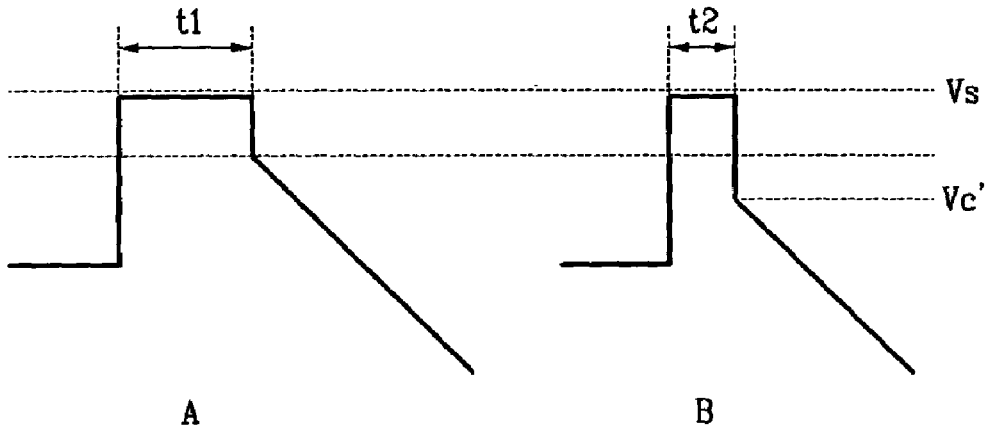
FIG. 9 shows a PDP driving waveform according to the first and second exemplary embodiments of the present invention.

As shown by "A" of FIG. 9, a falling ramp may be applied, after a sustain discharge voltage is applied in the latter part of the sustain discharge period of a previous subfield, without applying a rising ramp pulse in the reset period of the second to eighth subfields. However, a reset discharge may not be generated until a period of time after applying the falling ramp pulse, and since the capacitor $C_2$ is to be sufficiently charged before the falling ramp is applied, the voltage at the Y electrode may be maintained at the sustain discharge voltage $V_s$ during the time $t_1$ in which the capacitor $C_2$ is charged.

However, when the falling ramp driving circuit according to the first and second exemplary embodiments is utilized, as shown by "B" of FIG. 9, the time for charging the capacitor $C_2$ may be reduced to a time of $t_2$ since the capacitor $C_2$ may be charged with a voltage of $V_{c'}$, which is the difference between the voltage at the Y electrode of the capacitor $C_p$ and the breakdown voltage of the Zener diode $D_3$.

Also, when the transistor $M_5$ is turned on in the falling ramp period, similar to the first and second exemplary embodiments, the voltage at the Y electrode of the capacitor $C_p$ may be instantly reduced to the charged voltage of $V_{c'}$, and the voltage at the Y electrode of the capacitor $C_p$ is then further reduced to the ground voltage by a falling ramp. Accordingly, the length of time of the falling ramp period may be reduced.

As described, the initial voltage of the Y ramp falling period may be reduced to a voltage at which a weak reset discharge is generated by controlling, through a zener diode, a voltage charged in a capacitor in a Y ramp rising period, thereby eliminating an unnecessary time during which no discharge is generated in the initial part of the Y ramp falling period and reducing a time of the reset period. Also, reducing the reset time may reduce the total driving time.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel driver for applying a reset driving waveform in a ramp pulse format to a panel capacitor, comprising:

a transistor having a drain electrode coupled to a first terminal of the panel capacitor and a source electrode coupled to a power source;

a capacitor having a first terminal coupled to a gate electrode of the transistor;

a Zener diode having an anode coupled to a second terminal of the capacitor; and a first resistor and a diode coupled between a cathode of the Zener diode and the drain electrode of the transistor, wherein the first resistor and the diode are coupled in parallel to each other.

2. The plasma display panel driver of claim 1, wherein a voltage at the panel capacitor is reduced by a breakdown voltage of the Zener diode when the transistor is turned on.

3. The plasma display panel driver of claim 1, wherein the capacitor is charged with a voltage that is less than the voltage applied to the first terminal of the panel capacitor by an amount of a breakdown voltage of the Zener diode.

4. The plasma display panel driver of claim 1, wherein the power source supplies a final voltage of a falling ramp reset pulse driving waveform.

5. The plasma display panel driver of claim 1, further comprising a second resistor coupled in series between the second terminal of the capacitor and the anode of the Zener diode.

* * * * *